US010160524B2

(12) United States Patent
Van Der Nat

(10) Patent No.: US 10,160,524 B2
(45) Date of Patent: Dec. 25, 2018

(54) METHOD AND ASSEMBLY FOR TRANSFERRING FLUIDS BETWEEN A FIRST VESSEL AND A SECOND VESSEL

(71) Applicant: Bluewater Energy Services B.V., Hoofddorp (NL)

(72) Inventor: Clemens Gerardus Johannes Maria Van Der Nat, The Hague (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 0 days.

(21) Appl. No.: 15/549,339

(22) PCT Filed: Feb. 19, 2015

(86) PCT No.: PCT/EP2015/053482
§ 371 (c)(1),
(2) Date: Aug. 7, 2017

(87) PCT Pub. No.: WO2016/131486
PCT Pub. Date: Aug. 25, 2016

(65) Prior Publication Data

US 2018/0022425 A1 Jan. 25, 2018

(51) Int. Cl.
*B63B 27/34* (2006.01)
*B63B 27/25* (2006.01)
(Continued)

(52) U.S. Cl.
CPC ..... *B63B 27/34* (2013.01); *B63B 22/02* (2013.01); *B63B 27/24* (2013.01); *B63B 27/25* (2013.01)

(58) Field of Classification Search
CPC ..... B63B 22/02; B63B 22/021; B63B 22/023; B63B 22/026; B63B 27/25; B63B 27/34; B63B 35/44
(Continued)

(56) References Cited

U.S. PATENT DOCUMENTS 5,803,779 A 9/1998 Horton, III
6,390,733 B1 5/2002 Burbage et al.
(Continued)

FOREIGN PATENT DOCUMENTS

WO 0102242 A1 1/2001

OTHER PUBLICATIONS

International Search Report dated Oct. 6, 2015 for corresponding International Application PCT/EP2015/053482, filed Feb. 19, 2015.
(Continued)

*Primary Examiner* — Lars A Olson
(74) *Attorney, Agent, or Firm* — Steven M. Koehler; Westman, Champlin & Koehler, P.A.

(57) ABSTRACT

A method for transferring fluids between a first vessel and a second vessel, comprises establishing a direct mooring connection between the first and second vessels using a mooring line, positioning and maintaining a third vessel closer to the second vessel than to the first vessel, providing a first fluid transfer hose and connecting it with a first end to a fluid outlet on the first vessel and with a second end to an intermediate fluid inlet at the third vessel, providing a second fluid transfer hose and connecting it with a first end to an intermediate fluid outlet at the third vessel and with a second end to a fluid inlet on the second vessel and establishing a fluid communication between the intermediate fluid inlet and intermediate fluid outlet.

35 Claims, 3 Drawing Sheets

(51) Int. Cl.
*A63B 22/02* (2006.01)
*B63B 22/02* (2006.01)
*B63B 27/24* (2006.01)

(58) Field of Classification Search
USPC ..... 441/3, 4, 5
See application file for complete search history.

(56) References Cited

U.S. PATENT DOCUMENTS

| | | | | |
|---|---|---|---|---|
| 7,594,836 | B2 * | 9/2009 | Kristensen | B63B 22/021 441/5 |
| 2004/0238176 | A1 * | 12/2004 | Appleford | B63B 22/021 166/353 |
| 2008/0096448 | A1 * | 4/2008 | Lokken | B63B 22/021 441/4 |
| 2008/0242165 | A1 * | 10/2008 | Adkins | B63B 22/021 441/4 |
| 2011/0223820 | A1 * | 9/2011 | Lunde | B63B 22/023 441/5 |

OTHER PUBLICATIONS

Written Opinion of the International Searching Authority dated Aug. 25, 2016 for corresponding International Application PCT/EP2015/053482, filed Feb. 19, 2015.

* cited by examiner

METHOD AND ASSEMBLY FOR TRANSFERRING FLUIDS BETWEEN A FIRST VESSEL AND A SECOND VESSEL

CROSS-REFERENCE TO RELATED APPLICATION

The present application is a national stage of and claims priority of International patent application Serial No. PCT/EP2015/053482, filed Feb. 19, 2015.

BACKGROUND

The invention in a first aspect relates to a method for transferring fluids between a first vessel and a second vessel.

A main field of application of such a method is the offshore production of oil and gas. The first vessel, for example, may comprise a so-called FPSO (Floating Production, Storage and Offloading vessel) from which oil or gas, such as liquefied natural gas, has to be transferred to a tanker. A known method uses a floating fluid transfer hose connecting the first vessel with the second vessel. A disadvantage of such a method is that its use is limited to circumstances with moderate sea states (significant wave heights up to 2-3 meters). For higher sea states forces generated by the floating fluid transfer hose reach a level exceeding design values of a hose handling system of the tanker. Such a tanker generally is equipped with a midship manifold to which the fluid transfer hose has to be connected and such a manifold cannot cope with forces generated by the fluid transfer hose at high sea states. When one desires to transfer fluids at such extreme conditions, specially designed (or "dedicated") vessels (such as dedicated tankers) are used as second vessel, which for example may be provided with a bow loading station specially designed for receiving the fluid transfer hose and capable of withstanding the increased forces generated at high sea states.

SUMMARY

An alternative method for transferring fluids between a first vessel and a second vessel allows transfer of fluids at more extreme conditions (such as higher sea states) without the need for using a specially designed ("dedicated") second vessel and allows the use of a standard ("non-dedicated") vessel, such as a standard tanker.

The method comprises establishing a direct mooring connection between the first and second vessels using a mooring line, positioning and maintaining a third vessel closer to the second vessel than to the first vessel, providing a first fluid transfer hose and connecting it with a first end to a fluid outlet on the first vessel and with a second end to an intermediate fluid inlet at the third vessel, providing a second fluid transfer hose and connecting it with a first end to an intermediate fluid outlet at the third vessel and with a second end to a fluid inlet on the second vessel and establishing a fluid communication between the intermediate fluid inlet and intermediate fluid outlet.

The third vessel is not part of the mooring connection between the first and second vessels, but serves as a support for the first and second fluid transfer hoses and defines the position where the first and second fluid transfer hoses are brought into a fluid communication. Because of its specific (and maintained) location closer to the second vessel, the forces generated by the second fluid transfer hose on the second vessel (and specifically on devices thereof for handling, receiving and connecting to the second fluid transfer hose, such as a manifold on a tanker) will be reduced substantially, allowing to proceed with the fluid transferring method at higher sea states (for example up to significant wave heights of 4-5 meters) without the need to fall back on the use of a dedicated second vessel.

The second vessel is directly moored to the first vessel (for example in a so-called tandem mooring configuration). The first vessel, as in the state of the art, may be moored in any appropriate manner, such as being provided with a turret which is moored to the sea bed.

It should be noted that the order in which the steps of the present method are carried out, may be varied. However, generally establishing a mooring connection between the first and second vessels and positioning and maintaining the third vessel as stated, will proceed the steps of providing the first and second fluid transfer hoses and establishing a fluid communication there between.

In one embodiment, the step of establishing a fluid communication between the intermediate fluid inlet and intermediate fluid outlet at the third vessel comprises providing a fluid line on the third vessel having opposite ends which define said intermediate fluid inlet and said intermediate fluid outlet, respectively. Such a fluid line may be a fixed part on the third vessel, but also may be a removable fluid line which is mounted to the third vessel when required.

In such an embodiment it is possible that the fluid line is provided such that the opposite ends thereof will be located on the third vessel, as seen in a top plan view. Thus the fluid transfer hoses pass over the third vessel, then.

Alternatively, the opposite ends of the fluid line will be located at opposite (port/starboard or fore/aft) sides, or at sufficiently remote portions, outboard of the third vessel. As a result the first and second fluid transfer lines, once connected to the fluid line, remain clear from the third vessel. This results in a configuration in which the risk of the first and second fluid transfer hoses engaging each other is minimized.

As an alternative the step of establishing a fluid communication between the intermediate fluid inlet and intermediate fluid outlet at the third vessel comprises attaching a part of the first fluid transfer hose near its second end to the third vessel and attaching a part of the second fluid transfer hose near its first end to the third vessel and directly connecting the second end of the first fluid transfer hose, which then defines the intermediate fluid outlet at the third vessel, to the first end of the second fluid transfer hose, which then defines the intermediate fluid inlet at the third vessel.

In such an alternative embodiment a fluid line as described above is not used, but the first and second fluid transfer hoses are connected to each other directly at their second and first ends, respectively. For assuring that the position of the first and second fluid transfer hoses relative to the third vessel is maintained, said fluid transfer hoses are attached to the third vessel in any appropriate manner (for example using disconnectable cooperating attachment members on the third vessel and on the fluid transfer hoses or using a supporting wire between the third vessel and the disconnectable cooperating attachment members).

It is also conceivable that the second end of the first fluid transfer hose and the first end of the second fluid transfer hose in the connected state are positioned below sea level and are supported by a hoisting device connected to the third vessel. In such an embodiment the fluid transfer hoses do not pass over the third vessel. The hoisting device, for example, may be a hoisting cable.

In another embodiment of the method, the step of providing a second fluid transfer hose and connecting it with a first end to an intermediate fluid outlet at the third vessel and with a second end to a fluid inlet on the second vessel comprises providing a second fluid transfer hose such as to assume an at least partly submerged catenary type position below sea level. This may further improve the handling of said second fluid transfer hose in higher sea states because of a reduced response to the impact of waves.

As an alternative the step of providing a second fluid transfer hose and connecting it with a first end to an intermediate fluid outlet at the third vessel and with a second end to a fluid inlet on the second vessel may comprise the step of providing a bridge member bridging a gap between the third and second vessels and the step of supporting the second fluid transfer hose on said bridge member. In such an embodiment the second fluid transfer hose is of an aerial type and is not in contact with the sea and as such is not subjected to forces generated by waves or currents. The use of such a bridge member is made possible because of the reduced distance between the third vessel and second vessel.

It is also possible that the step of providing a second fluid transfer hose and connecting it with a first end to an intermediate fluid outlet at the third vessel and with a second end to a fluid inlet on the second vessel comprises the step of providing a tower structure on the third vessel and connecting the first end of the second fluid transfer hose therewith such that said second fluid transfer hose extends in an aerial manner towards the second vessel. Then, it is also conceivable that a supporting wire is provided between the tower structure and second vessel for supporting the second fluid transfer hose.

In yet another embodiment the step of providing a first fluid transfer hose and connecting it with a first end to a fluid outlet on the first vessel and with a second end to an intermediate fluid inlet at the third vessel comprises providing a first fluid transfer hose such as to assume an at least partly submerged catenary type position below sea level. This likewise may further improve the handling of said first fluid transfer hose in higher sea states because of a reduced response to the impact of waves.

The positioning and maintaining of the third vessel closer to the second vessel than to the first vessel may occur in many different ways, and for example may comprise using a differential absolute and relative positioning sensor (DARPS) which cooperates with propulsion members of the third vessel.

The third vessel after being positioned is maintained within a defined range from the fluid inlet of the second vessel, preferably within a range of 50 meters, and more preferably within a range of 20 meters.

The step of establishing a direct mooring connection between the first and second vessels using a mooring line may comprise the use of a hawser.

The first and/or second fluid transfer hoses may be single hoses, but also may define multiple fluid transfer hoses. This means that a fluid transfer hose as defined within the context of the present invention may comprise a number of hoses or a bundle of fluid transfer hoses or may comprise a single fluid transfer hose within which a number of separate fluid channels are provided.

In a second aspect the invention relates to an assembly for transferring fluids, comprising a first vessel, a second vessel, means for establishing a direct mooring connection between the first and second vessels, a third vessel positioned and maintained closer to the second vessel than to the first vessel, a first fluid transfer hose connected with a first end to a fluid outlet of the first vessel and with a second end to an intermediate fluid inlet at the third vessel and a second fluid transfer hose connected with a first end to an intermediate fluid outlet at the third vessel and with a second end to a fluid inlet of the second vessel, and wherein a fluid communication is established between the intermediate fluid inlet and intermediate fluid outlet.

The third vessel may be provided with a fluid line having opposite ends which define said intermediate fluid inlet and said intermediate fluid outlet, respectively (for connecting to the first and second fluid transfer hoses, respectively).

In one embodiment the opposite ends of the fluid line are on the third vessel, as seen in a top plan view, but alternatively are located at opposite (port/starboard or fore/aft) sides, or at sufficiently remote portions, outboard of the third vessel, such as to prevent a clash (below sea level) between the first and second fluid transfer hoses and between these hoses and the third vessel.

In an alternative embodiment of the assembly a part of the first fluid transfer hose near its second end is attached to the third vessel and a part of the second fluid transfer hose near its first end is attached to the third vessel and wherein the second end of the first fluid transfer hose, which then defines the intermediate fluid outlet at the third vessel, is directly connected to the first end of the second fluid transfer hose, which then defines the intermediate fluid inlet at the third vessel. This means that the first and second fluid transfer hoses are directly connected to each other without the use of an intermediate fluid line and are attached to the third vessel.

It is noted that the third vessel may be provided with any devices required for handling the fluid transfer hoses, for example a hose reel for storing the second fluid transfer hose.

It is possible that the third vessel comprises a hoisting means for connecting to the assembly of second end of the first fluid transfer hose and first end of the second fluid transfer hose, in a connected state, and for positioning it below sea level.

In one embodiment the second fluid transfer hose is of a type assuming an at least partly submerged catenary type position below sea level, such as to reduce forces generated.

In an alternative embodiment the assembly further comprises a bridge member bridging a gap between the third and second vessels and supporting the second fluid transfer hose. Such a bridge member may be a (movable) part of the third vessel, or a (movable) part of the second vessel or even may be a separate bridge member which may be installed and removed as desired.

As an alternative the third vessel may comprise a tower structure connected to the first end of the second fluid transfer hose, wherein said second fluid transfer hose extends in an aerial manner towards the second vessel. Then it further is possible that a supporting line extends between the tower structure and the second vessel for supporting the second fluid transfer hose In one embodiment the first fluid transfer hose is of a type assuming an at least partly submerged catenary type position below sea level, again to reduce forces generated.

The third vessel may comprises a differential absolute and relative positioning sensor (DARPS) (for cooperation with propulsion members of the third vessel).

The first and/or second fluid transfer hoses may define multiple fluid transfer hoses.

When, in accordance with a special embodiment, the intermediate fluid outlet and intermediate fluid inlet at the third vessel are located at locations of expected minimum vessel movements, a further reduction of the influence of the sea state may be obtained.

The fluid line of the third vessel, if applied, may comprise at least one of emergency shutdown valves, surge relieve systems and quick disconnect connectors, such as to ensure the safety of the fluid transfer under a wide range of circumstances, and specifically during a disconnect of the fluid transfer hoses.

The direct mooring connection between the first and second vessels may comprise a hawser. Further, the first vessel may be moored on a mooring system in a weather-vaning configuration (for example using a so-called turret configuration).

In one embodiment the second vessel is a tanker comprising a manifold defining the fluid inlet for connecting to the second end of the second fluid transfer hose. Such a manifold is a standard part of a tanker for loading and unloading fluids in a standardized manner and now may be used in connection with the present invention without the need for any adaption.

The third vessel is positioned within a defined range from the fluid inlet of the second vessel, preferably within a range of 50 meters, and more preferably within a range of 20 meters.

In the vicinity of at least one of the ends of the first and/or second fluid transfer hoses a buoyancy member may be provided, for preventing the sinking of these ends and for reducing the so-called hang-off weight of the fluid transfer hoses.

In a third aspect the invention relates to a third vessel intended for use in a method and in an assembly according to the present invention.

BRIEF DESCRIPTION OF THE DRAWING

Hereinafter aspects of the invention will be elucidated while referring to the drawing, in which.

DETAILED DESCRIPTION

Figure 1:
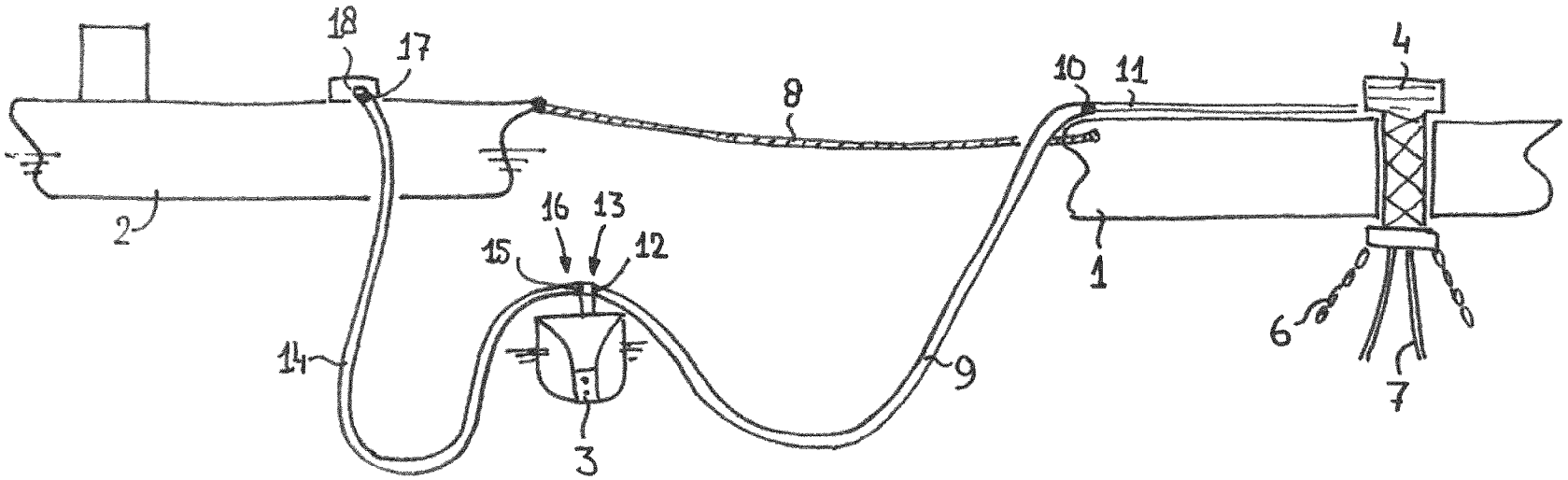
FIG. 1 schematically shows the lay-out of an assembly.

Firstly referring to FIG. 1 a general lay-out of an assembly for transferring fluids is shown in a schematic manner. FIG. 1 only intends to clarify the positional relations between the constitutive parts of the assembly without intending to give specific details about constructional details or dimensions.

The assembly for transferring fluids basically comprises a first vessel 1, a second vessel 2 and a third vessel 3. The first vessel 1 for example comprises an FPSO which by means of a well-known assembly of turret 4 in a weathervaning manner may be moored to the seabed by mooring lines 6. Production lines or risers 7 (for example for oil or gas) enter the vessel 1 via the buoy 5 and turret 4 and (in a manner well-known and not shown in detail here) connect to piping or other equipment on the first vessel 1.

It is noted that other mooring concepts may be used too for the first vessel 1, such as spread mooring or using a dynamic positioning system. Further the first vessel 1 also may be of another type, for example an FLNG (Floating Liquefied Natural Gas vessel).

The first vessel 1 and second vessel 2 are connected by means for establishing a direct mooring connection there between, such as a hawser 8. As a result in the illustrated configuration a so-called tandem mooring is obtained. Other mooring configuration may be conceivable, however.

The third vessel 3 (which may be an offshore vessel, OSV, and which within the context of the present invention operates as a fluid hose transfer vessel) is positioned and (in a manner to be described later) maintained closer to the second vessel 2 than to the first vessel 1. A first fluid transfer hose 9 is provided which with a first end 10 is connected to a fluid outlet 11 of the first vessel 1 of which the location may be chosen at any convenient location on the first vessel 1; for example such a fluid outlet 11 also may be located at the end of the first vessel to reduce the length of the first fluid transfer hose. The first fluid transfer hose 9 at its second end 12 is connected to an intermediate fluid inlet 13 located at the third vessel 3, the details of which will appear later.

A second fluid transfer hose 14 is provided which with a first end 15 is connected to an intermediate fluid outlet 16 at the third vessel (the details of which will follow below) and which with a second end 17 is connected to a fluid inlet 18 of the second vessel 2 (for example a midship manifold as present on a standard- or non-dedicated-tanker). In a manner to be described later a fluid communication is established between the intermediate fluid inlet 13 and intermediate fluid outlet 16.

When fluids (for example oil, gas or LNG) have to be transferred between the first vessel 1 and the second vessel 2, the following steps are carried out (not necessarily in the described order): the step of establishing a direct mooring connection between the first and second vessels 1, 2 using a mooring line such as the hawser 8, the step of positioning and maintaining the third vessel 3 closer to the second vessel 2 than to the first vessel 1, the step of providing the first fluid transfer hose 9 and connecting it with its first end 10 to the fluid outlet 11 on the first vessel 1 and with its second end 12 to the intermediate fluid inlet 13 which is located at the third vessel 3, the step of providing the second fluid transfer hose 14 and connecting it with its first end 15 to the intermediate fluid outlet 16 which is located at the third vessel 3 and with its second end 17 to the fluid inlet or manifold 18 on the second vessel 2 and the step of establishing a fluid communication between the intermediate fluid inlet 13 and intermediate fluid outlet 16.

Figure 2:
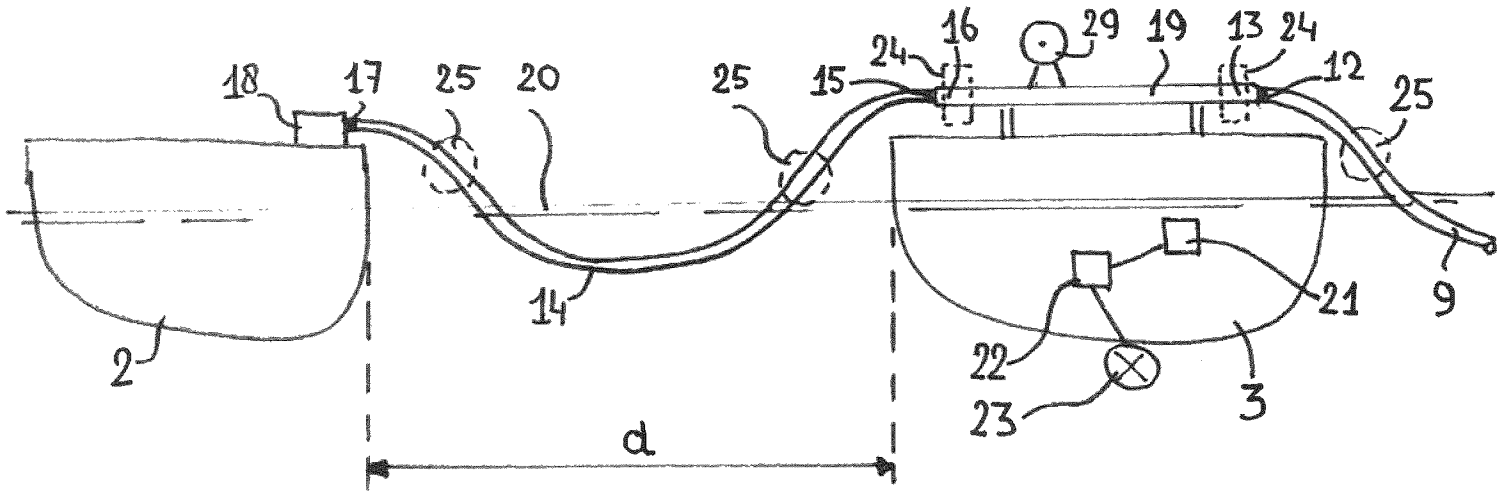
FIG. 2 schematically shows a detail of a first embodiment of the assembly.

FIG. 2 shows a detail of a first embodiment of the assembly. In this figure (but also in the following FIGS. 3 and 4) the first vessel 1 has not been illustrated. In this embodiment the third vessel 3 is provided with a fluid line 19 having opposite ends which define the said intermediate fluid inlet 13 and said intermediate fluid outlet 16, respectively. This fluid line 19 (which may be a rigid or flexible line) may be attached to the third vessel 3 in a permanent state or in a removable manner. In this embodiment the opposite ends or intermediate fluid inlet/outlet 13,16 of the fluid line 19 are located inboard of the third vessel 3, as considered in a top plan view, and specifically these opposite ends 13,16 of the fluid line 19 are located at opposite (port and starboard) sides of the third vessel 3.

The fluid line 19 may be part of a larger system through which the fluids are transported between the intermediate fluid inlet 13 and the intermediate fluid outlet 16, which system may comprise further components, as will appear below).

In FIG. 2 the sea level has been represented by 20 and one can see that both the first fluid transfer hose 9 and the second fluid transfer hose 14 are of a type assuming an at least partly submerged catenary type position below sea level 20. In embodiments not illustrated at least one of said hoses also may be of a floating type. It even may be considered that the hoses 9,14 are of a hybrid type (partly submerged and partly floating).

As stated before the third vessel 3 is positioned and maintained (preferably as stable as possible) closer to the second vessel 2 than to the first vessel 1. For this reason the third vessel 3 may be provided with positioning means, for example comprising a differential absolute and relative positioning sensor (DARPS) 21 connected to control means 22 for controlling propulsion means or thrusters 23 of the third vessel 3. Using such means the third vessel 3 may be positioned and maintained within or at a defined range d from the fluid inlet 18 of the second vessel 2, preferably within a range "d" of 50 meters, and more preferably within a range "d" of 20 meters.

For minimising the effect of sea states to the movement of the fluid transfer hoses 9,14, and especially the second fluid transfer hose 14, it may be advantageous to locate or position the intermediate fluid outlet 16 and intermediate fluid inlet 13 at the third vessel 3 at locations of expected minimum third vessel movements.

Further, as represented schematically in FIG. 2, the fluid line 19 of the third vessel 3 may comprises (as part of a shutdown system, for example) at least one of emergency shutdown valves, surge relieve systems and quick disconnect connectors (represented schematically by 24). Typically, telemetry connections using a so-called "green line" approach may be used to control such a shutdown system. The construction and function of such devices is known per se in the respective field of offshore technology and do not need further explanation here.

In the vicinity of at least one of the ends 10,12 and 15,17 of the first and/or second fluid transfer hoses 9,14, respectively, buoyancy members 25 may be provided. It is noted that the position where these buoyancy members 25 have been represented in FIG. 1 is not meant to be indicative for the exact location thereof but merely is schematical. FIG. 2 also schematically represents a hose reel 29 provided on the third vessel 3 for storing (part of) the second fluid transfer hose 14. Other equipment for handling the hoses 9,14 (such as cranes) may be provided too.

Figure 3:
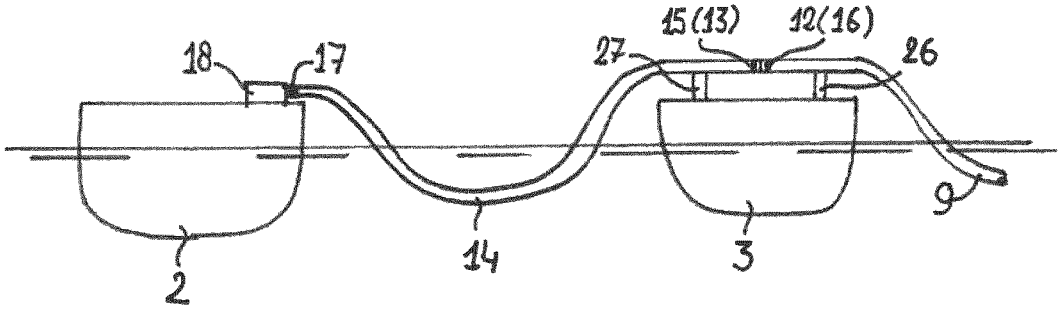
FIG. 3 schematically shows a similar detail of a second embodiment of the assembly.

Referring to FIG. 3, a second, alternative embodiment of the assembly is represented. In this embodiment the fluid line 19 is not used, but a part of the first fluid transfer hose 9 near its second end 12 is attached to the third vessel 3 (for example using a connector 26), whereas a part of the second fluid transfer hose 14 near its first end 15 too is attached to the third vessel 3 (for example using a connector 27). The second end 12 of the first fluid transfer hose 9 now is directly connected to the first end 15 of the second fluid transfer hose 14. In this embodiment, therefor, the second end 12 of the first fluid transfer hose 9 basically defines the intermediate fluid outlet 16 to which the first end 15 of the second fluid transfer hose 14 is connected; likewise the first end 15 of the second fluid transfer hose 14 then basically defines the intermediate fluid inlet 13 at the third vessel 3 to which the second end 12 of the first fluid transfer hose 9 is connected.

The connectors 26 and 27 may comprise cooperating members provided on the third vessel 3 and on the hoses 9,14.

Figure 4:
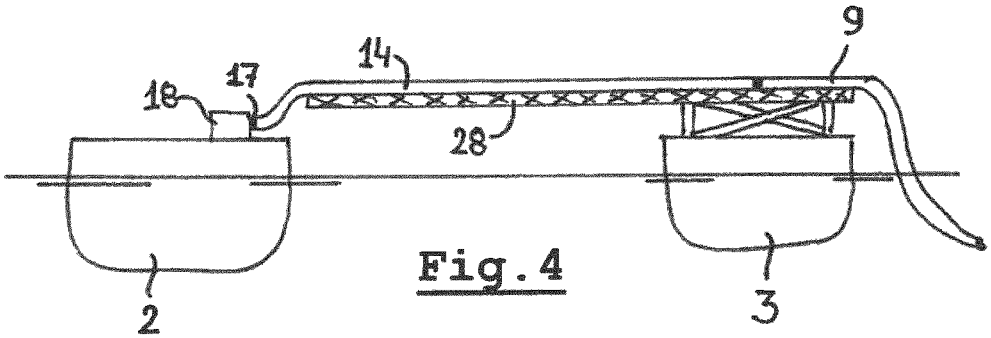
FIG. 4 schematically shows a similar detail of a third embodiment of the assembly.

Now referring to FIG. 4, a further embodiment of the assembly is represented. In this embodiment a bridge member 28 is provided bridging the gap between the third vessel 3 and second vessel 2. This bridge member 28 supports the second fluid transfer hose 14. In the illustrated embodiment the bridge member 28 is attached (possibly in a removable manner) to the third vessel 28 only, but in a similar manner it also may be attached to the second vessel 2 only. A connection of the bridge member 28 to both vessels 2 and 3 generally will not be possible because of the inevitable relative movements between both vessels (notwithstanding the general concept of keeping the third vessel 3 as stable a possible relative to the second vessel 2). The manner in which the bridge member 28 is attached to any of the vessels 2 and 3 may vary, and even may be devised to allow movements of the bridge member relative to the respective vessel it is attached to for allowing compensating movements of the bridge member 28.

Although the bridge member 28 has been illustrated as a beam or similar in FIG. 4, also other constructions are conceivable, such as a non-rigid construction constructed of wires, as will appear below with respect to FIG. 6. The second fluid transfer hose 14 not necessarily has to rest on top of the bridge member 28 (as illustrated) but also may be suspended below it in any convenient manner.

Figure 5:
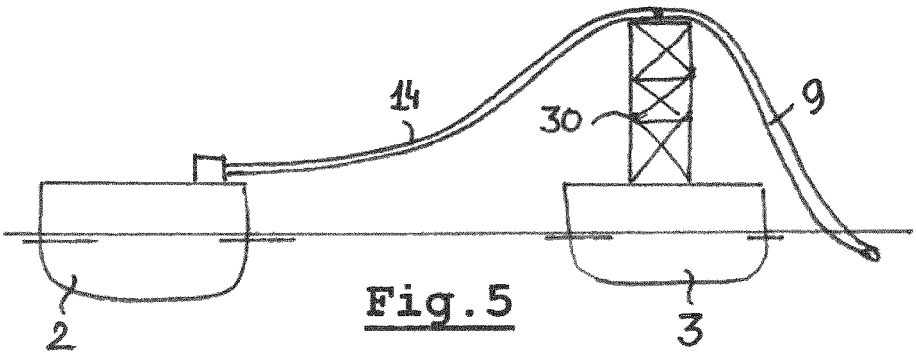
FIG. 5 schematically shows a similar detail of a fourth embodiment of the assembly.

In FIG. 5 an embodiment is illustrated, in which the third vessel comprises a tower structure 30 connected to the first end 15 of the second fluid transfer hose 14, wherein as a result said second fluid transfer hose 14 extends in an aerial manner towards the second vessel 2.

Figure 6:
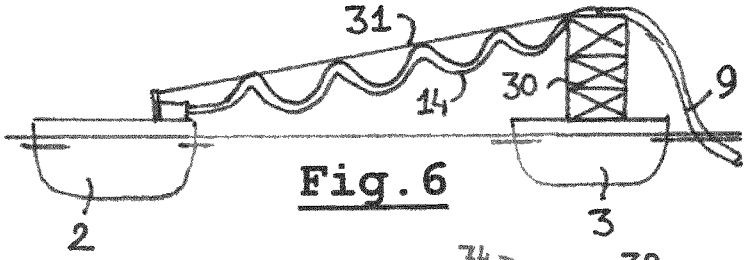
FIG. 6 schematically shows a similar detail of a fifth embodiment of the assembly.

The embodiment of FIG. 6 resembles that of FIG. 5, but an additional supporting line 31 extends between the tower structure 30 and the second vessel 2 for supporting the second fluid transfer hose 14.

Figure 7:
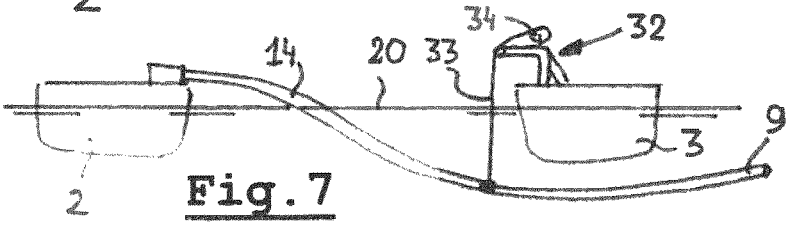
FIG. 7 schematically shows a similar detail of a sixth embodiment of the assembly.

Finally in FIG. 7 an embodiment is illustrated in which the third vessel 3 comprises a hoisting means 32 (for example comprising a hoisting cable 33 with winch 34) for connecting to the assembly of second end 12 of the first fluid transfer hose 9 and first end 15 of the second fluid transfer hose 14, when in a connected state, and for positioning this assembly below sea level.

The invention is not limited to the embodiments described before which may be varied widely within the scope of the invention as defined by the appending claims. As such it is noted that the definition of "vessel" as used in the present context also may encompass other floating objects apart from vessels in the conventional meaning.

The invention claimed is:

1. A method for transferring fluids between a first vessel and a second vessel, comprising establishing a direct mooring connection between the first and second vessels using a mooring line, positioning and maintaining a third vessel closer to the second vessel than to the first vessel, providing a first fluid transfer hose and connecting a first end of the first fluid transfer hose to a fluid outlet on the first vessel and connecting a second end of the first fluid transfer hose to an intermediate fluid inlet at the third vessel, providing a second fluid transfer hose and connecting a first end of the second fluid transfer hose to an intermediate fluid outlet at the third vessel and connecting a second end of the second fluid transfer hose to a fluid inlet on the second vessel and establishing a fluid communication between the intermediate fluid inlet and intermediate fluid outlet.

2. The method according to claim 1, wherein establishing the fluid communication between the intermediate fluid inlet and intermediate fluid outlet at the third vessel comprises providing a fluid line on the third vessel having opposite ends which define said intermediate fluid inlet and said intermediate fluid outlet, respectively.

3. The method according to claim 2, wherein the opposite ends of the fluid line are located inboard of a perimeter edge of the third vessel.

4. The method according to claim 3, wherein opposite ends of the fluid line are located at opposite sides of the third vessel.

5. The method according to claim 1, wherein establishing the fluid communication between the intermediate fluid inlet and intermediate fluid outlet at the third vessel comprises attaching a part of the first fluid transfer hose near its second end to the third vessel and attaching a part of the second fluid transfer hose near its first end to the third vessel and directly connecting the second end of the first fluid transfer hose, which then defines the intermediate fluid outlet at the third vessel, to the first end of the second fluid transfer hose, which then defines the intermediate fluid inlet at the third vessel.

6. The method according to claim 5, wherein a connection formed between the second end of the first fluid transfer hose and the first end of the second fluid transfer hose is positioned below sea level and is supported by a hoisting device connected to the third vessel.

7. The method according to claim 1, wherein the second fluid transfer hose is configured in an at least partly submerged catenary type position below sea level.

8. The method according to claim 1, further comprising providing a bridge member bridging a gap between the third and second vessels and supporting the second fluid transfer hose on said bridge member.

9. The method according to claim 1, further comprising providing a tower structure on the third vessel and connecting the first end of the second fluid transfer hose therewith such that said second fluid transfer hose extends in an aerial manner towards the second vessel.

10. The method according to claim 9, further comprising providing a supporting wire between the tower structure and second vessel for supporting the second fluid transfer hose.

11. The method according to claim 1, wherein the first fluid transfer hose is configured in an at least partly submerged catenary type position below sea level.

12. The method according to claim 1, wherein positioning and maintaining the third vessel closer to the second vessel than to the first vessel comprises using a differential absolute and relative positioning sensor (DARPS).

13. The method according to claim 1, wherein the third vessel after being positioned is maintained within a defined range from the fluid inlet of the second vessel.

14. The method according to claim 1, wherein establishing the direct mooring connection between the first and second vessels using the mooring line comprises the use of a hawser.

15. The method according to claim 1, wherein the first and/or second fluid transfer hoses define multiple fluid transfer hoses.

16. An assembly for transferring fluids, comprising a first vessel, a second vessel, a direct mooring connection between the first and second vessels, a third vessel positioned and maintained closer to the second vessel than to the first vessel, a first fluid transfer hose connected with a first end to a fluid outlet of the first vessel and with a second end to an intermediate fluid inlet at the third vessel and a second fluid transfer hose connected with a first end to an intermediate fluid outlet at the third vessel and with a second end to a fluid inlet of the second vessel, and wherein a fluid communication is established between the intermediate fluid inlet and intermediate fluid outlet.

17. The assembly according to claim 16, wherein the third vessel is provided with a fluid line having opposite ends which define said intermediate fluid inlet and said intermediate fluid outlet, respectively.

18. The assembly according to claim 17, wherein the opposite ends of the fluid line are located on the third vessel inboard of a perimeter edge of the third vessel.

19. The assembly according to claim 17, wherein the opposite ends of the fluid line are located at sufficiently remote portions, outboard of the third vessel.

20. The assembly according to claim 16, wherein a part of the first fluid transfer hose near its second end is attached to the third vessel and a part of the second fluid transfer hose near its first end is attached to the third vessel and wherein the second end of the first fluid transfer hose, which then defines the intermediate fluid outlet at the third vessel, is directly connected to the first end of the second fluid transfer hose, which then defines the intermediate fluid inlet at the third vessel.

21. The assembly according to claim 20, wherein the second end of the first fluid transfer hose and the first end of the second fluid transfer hose, in a connected state, comprise an assembly, and wherein the third vessel comprises a hoisting device configured to position the assembly below sea level.

22. The assembly according to claim 16, wherein the second fluid transfer hose is of a type assuming an at least partly submerged catenary type position below sea level.

23. The assembly according to claim 16, further comprising a bridge member bridging a gap between the third and second vessels and supporting the second fluid transfer hose.

24. The assembly according to claim 16, wherein the third vessel comprises a tower structure connected to the first end of the second fluid transfer hose, wherein said second fluid transfer hose extends in an aerial manner towards the second vessel.

25. The assembly according to claim 24, wherein a supporting line extends between the tower structure and the second vessel for supporting the second fluid transfer hose.

26. The assembly according to claim 16, wherein the first fluid transfer hose is of a type assuming an at least partly submerged catenary type position below sea level.

27. The assembly according to claim 16, wherein the third vessel comprises a differential absolute and relative positioning sensor (DARPS).

28. The assembly according to claim 16, wherein the first and/or second fluid transfer hoses define multiple fluid transfer hoses.

29. The assembly according to claim 16, wherein the intermediate fluid outlet and intermediate fluid inlet at the third vessel are located at locations of expected minimum vessel movements.

30. The assembly according to claim 17, wherein the fluid line of the third vessel comprises at least one of emergency shutdown valves, surge relieve systems and quick disconnect connectors.

31. The assembly according to claim 16, wherein the direct mooring connection between the first and second vessels comprises a hawser.

32. The assembly according to claim 16, wherein the first vessel is moored on a mooring system in a weathervaning configuration.

33. The assembly according to claim 16, wherein the second vessel is a tanker comprising a manifold defining the fluid inlet for connecting to the second end of the second fluid transfer hose.

34. The assembly according to claim 16, wherein the third vessel is positioned within a defined range from the fluid inlet of the second vessel.

35. The assembly according to claim 16, and further comprising a buoyancy member in a vicinity of at least one of the ends of the first and/or second fluid transfer hoses.

* * * * *